US005082033A

United States Patent [19]

Weiss

[11] Patent Number: 5,082,033

[45] Date of Patent: Jan. 21, 1992

[54] DEVICE FOR FILLING CONTAINERS SUCH AS BOTTLES IN COUNTERPRESSURE FILLING MACHINES

[75] Inventor: Wilhelm Weiss, Lappersdorf, Fed. Rep. of Germany

[73] Assignee: Krones AG Hermann Kronseder Maschinenfabrik, Neutraubling, Fed. Rep. of Germany

[21] Appl. No.: 597,887

[22] Filed: Oct. 15, 1990

Related U.S. Application Data

[62] Division of Ser. No. 380,153, Jul. 14, 1989, Pat. No. 4,989,650.

[30] Foreign Application Priority Data

Jul. 23, 1988 [DE] Fed. Rep. of Germany ..... 3825093

[51] Int. Cl.[5] ..... B67C 3/06

[52] U.S. Cl. ..... 141/39; 141/6; 141/40; 141/44; 141/47; 141/50; 141/198

[58] Field of Search ..... 141/4, 5, 6, 7, 8, 39, 141/40, 44, 47, 48, 49, 50, 198, 291, 292, 293, 294, 266, 302, 305, 307

[56] References Cited

U.S. PATENT DOCUMENTS

| | | | |
|---|---|---|---|
| 3,380,488 | 4/1968 | Herbst | 141/39 X |
| 3,381,723 | 5/1968 | Quest | 141/39 |
| 4,201,249 | 5/1980 | Borstelmann | 141/39 |
| 4,369,820 | 1/1983 | Ahlers et al. | 141/39 |
| 4,381,808 | 5/1983 | Ahlers | 141/39 |
| 4,509,565 | 4/1985 | Ahlers | 141/39 |
| 4,589,453 | 5/1986 | Weiss | 141/39 |
| 4,637,438 | 1/1987 | Weiss | 141/6 |
| 4,644,981 | 2/1987 | Bernhard | 141/39 |
| 4,679,603 | 7/1987 | Rademacher et al. | 141/39 |

FOREIGN PATENT DOCUMENTS

| | | | |
|---|---|---|---|
| 685412 | 12/1939 | Fed. Rep. of Germany . | |
| 2838244 | 3/1979 | Fed. Rep. of Germany . | |
| 3429314 | 2/1986 | Fed. Rep. of Germany . | |
| 2164070 | 7/1973 | France . | |
| 256501 | 5/1988 | German Democratic Rep. . | |
| 392853 | 5/1933 | United Kingdom | 141/47 |
| 559079 | 2/1944 | United Kingdom | 141/6 |
| 642823 | 9/1950 | United Kingdom | 141/48 |
| 1092830 | 11/1967 | United Kingdom | 141/39 |
| 2162829 | 2/1986 | United Kingdom . | |

*Primary Examiner*—Ernest G. Cusick

*Attorney, Agent, or Firm*—Fuller, Ryan & Hohenfeldt

[57] ABSTRACT

An apparatus for filling bottles or other containers under the influence of counterpressure by of a filling unit, pressurized gas is led into the bottle after terminating the inflow of liquid, with the pressurized gas valve and liquid valve being closed and with a bypass of the gas return tube, and the liquid that thereby remains above the lower open tip of the gas return tube is expelled into a space having a lower pressure than exists in the bottle.

5 Claims, 3 Drawing Sheets

DEVICE FOR FILLING CONTAINERS SUCH AS BOTTLES IN COUNTERPRESSURE FILLING MACHINES

This is a divisional of copending application Ser. No. 07/380,153 filed on July 14, 1989, now Pat. No. 4,989,650.

BACKGROUND OF THE INVENTION

The invention disclosed herein relates to a method for filling bottles and the like and to a device for implementing the method.

The word "bottles" is used herein as a general designation for bottles, cans and other types of containers as well.

As is well known, counterpressure bottle filling machines comprise a closed annular storage tank which contains the liquid for filling the bottles and has a space for pressurized gas such as carbon dioxide or nitrogen above the liquid. Filler valves extend into the tank. As soon as a bottle becomes coupled to a filler valve, either before or without evacuation of the bottle, the bottle is filled with gas from the tank to assure that all air is displaced from the bottle The liquid valve is then opened and the gas contained in the bottle is usually returned to the tank through the same tube in the filler valve through which the gas was admitted to the bottle in the first place. Because in the counterpressure filling method the gas pressure in the bottle and in the tank are equalized when filling begins, the liquid flows into the bottle solely under the influence of gravity and foaming is inhibited.

Filler valves usually insert some liquid in the bottle which is in excess of the level to which the bottle should be filled. It is a well-known practice to expel the excess liquid by use of a pressurized gas charge which occurs after the liquid and pressurized gas filling valves have been closed. While the bottle is still coupled to the filler valve a fill level correction valve is opened for the purpose of allowing the pressurized gas in the bottle to expand correspondingly and force the excess liquid that lies above the lower tip of the gas feed and return tube into an annular channel which is below atmospheric pressure.

A merit of this system is that no special source of compressed gas is required for correcting fill level and the counterpressure filling machine can be designed in a simple manner. A disadvantage of this known method, however, is that the quantity of liquid which can be expelled from the bottle is dependent on the volume and the pressure of the pressurized gas in t[illegible] storage tank. This limits applicability of this method considerably. Thus, for example in practice, when bottles are filled all the way up to their rims under low counterpressure and the liquid being filled is one that foams intensely or when the container shapes are inconvenient to work with, satisfactory filling level correction is impossible.

In another well-known counterpressure filling method a low pressure that is slightly above atmospheric pressure is maintained in a separate region. After the bottle is filled, the gas return tube of the filler valve is connected to the lower pressure region so that the expansion of the gas enclosed in the bottle and in the passageways of the filling unit expel the excess liquid. The disadvantage of this system is that only a very small quantity of excess liquid can be expelled.

In another known type of counterpressure filling machine the bottles are connected with the atmosphere by means of the gas return tube and a throttle valve during the entire filling procedure. After filling of the liquid is complete and while the pressurized gas valve and the liquid feed valve are closed, inert gas under high pressure from a separate container is injected into the bottle for expelling the excess liquid. A good correction in the fill level does not take place in this case since the valve through which the liquid is admitted to the bottle is controlled by an electrical probe in such a way that the level of the liquid cannot rise to the tip of the gas return tube This known procedure operates with a continuous loss of pressurized gas as well as with the additional use of an inert gas, thus making it a very uneconomical method In addition, the equipment costs are high because of the additional compressed gas container and the electrical controls which are required.

In still another method for filling bottles under counterpressure conditions where the filler valve has a filling tube, there is a separate pressurized gas and gas return channel and a rotary slide valve for controlling the filling operation. After the liquid flows into the bottle, the rotary slide valve is again brought into the same position which it had while the bottle was being prepressurized before filling it with liquid In this method, the bottle is connected to a gas chamber in the container for the liquid which is to be filled by means of a pressurized gas line and gas return line while the filling tube is coupled to the atmosphere by way of a relief channel If a shut-off valve is now opened in the relief channel, then, under the influence of the high pressure resulting from the pressurized gas, the liquid in the gas return line empties into the bottle and the liquid as well as the entire contents of the filling tube are ejected into the atmosphere. This process results in enormous losses of liquid and is no longer used for economic reasons. In addition, the filling machine for practicing this method has a very complicated structure and is difficult to clean.

SUMMARY OF THE INVENTION

The main objective of the invention is to conduct reliable and precise fill level corrections even under the most undesirable filling circumstances.

A further objective is to provide a filling device which is simple in construction for carrying out the previously mentioned method while maintaining economical operating conditions.

According to the invention, the maximum fill level correction that can be obtained is completely independent of the volume and the pressure of the pressurized gas that is enclosed in the passageways of the filler valve and in the bottle. The required quantity of pressurized gas for displacement of the excess liquid in the bottle can be fed into the bottle at any time from the invariably present pressurized gas supply in the tank. As a consequence, precise fill level corrections can be carried out under all operating conditions, particularly when filling takes place at low counterpressure or when filling hot substances or filling to the rim and so forth. No independent compressed gas source nor inert gas source is required. The consumption of pressurized gas is low and it can be measured accurately whereby the pressurized gas that is already imposed in the bottle and in the passageways of the filler valve can be taken into consideration. Thus, the method is a very economical one and makes a constant filling level possible in bottles, cans and other containers.

An important characteristic of the invention is that when filling carbonated beverages, no carbon dioxide is liberated during correction of the fill level, since the lowered counterpressure is still maintained above the saturation pressure for carbon dioxide in the liquid.

The required quantity of pressurized gas from the storage tank at the pressure of the gas in the tank, is fed into the bottle during the fill level correction phase by means of a supplemental conduit from the tank and a shut-off valve. This conduit does not participate in the other phases of the filling operation such as prepressurization and is always free of liquid.

A safety valve in the correction gas feed line prevents the pressurized gas from escaping from the bottle when there is no bottle coupled to the filler valve.

How the foregoing and other objectives and features of the new method and valve structure are achieved will be evident in the ensuing more detailed description of embodiments of the invention taken in conjunction with the accompanying drawings.

DESCRIPTION OF A PREFERRED EMBODIMENT

Figure 1:
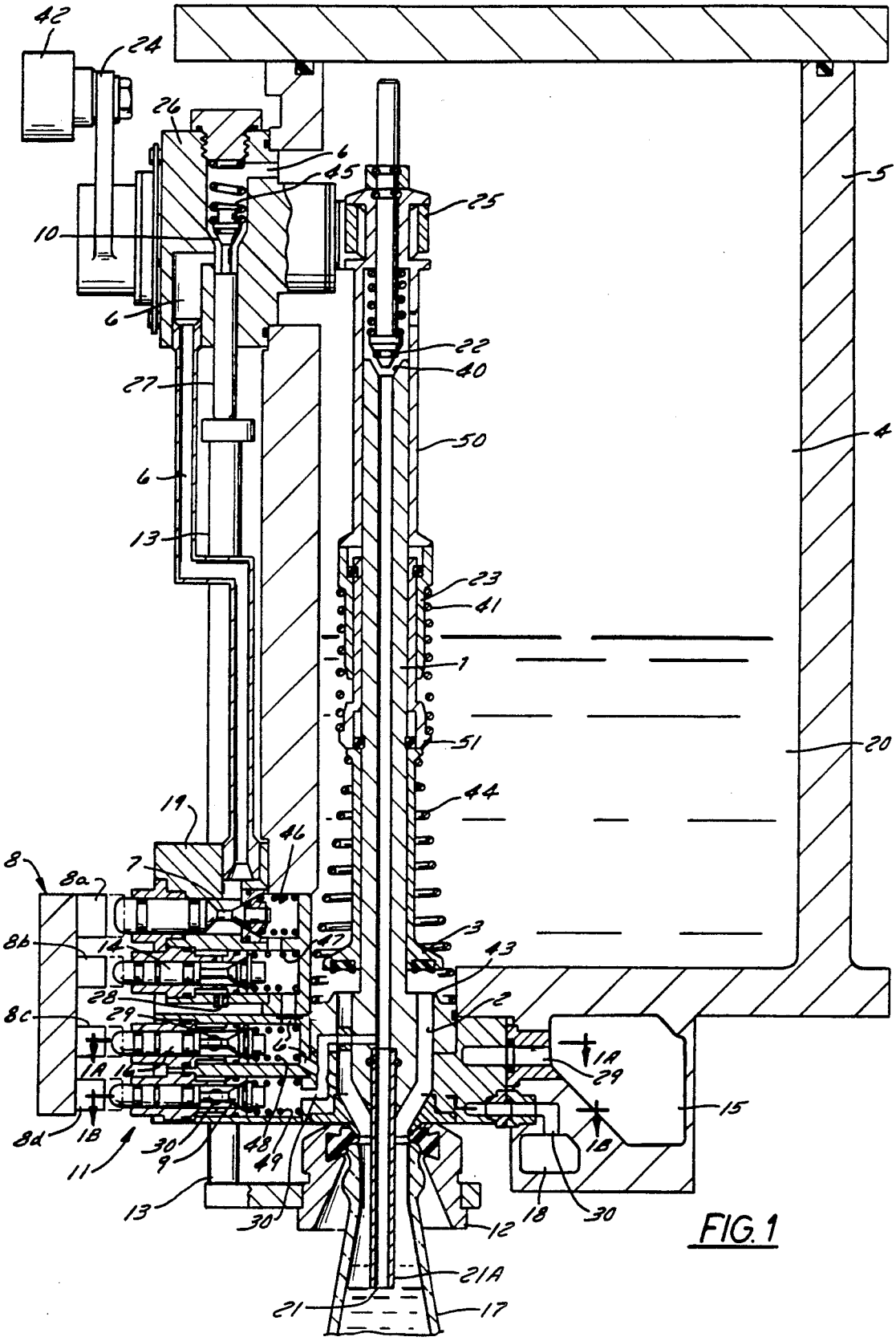
FIG. 1 is a vertical section through a counterpressure filling machine in the region of the filler valve.

FIG. 1 is a vertical section through a filler valve, according to the invention and a storage tank containing a liquid 20 which may be beer and a volume 4 above the liquid containing a pressurized inactive gas such as carbon dioxide. Only the neck portion of a bottle 17 that is to be filled with a liquid is illustrated. Any of several types of conveyors, having bottle raising and lowering devices, not shown, may be used to engage the bottle in sealing relationship with a rubber seal in a conventional centering bell 12. The toroidal-shaped tank 5 containing the fill liquid 20 and gas in gas filled space 4 is rotatable about a vertical axis Underneath tank 5 an annular vacuum chamber 15 is formed and a similar annular chamber 18 for gas involved in fill level correction is also formed In vacuum chamber 15, a vacuum is maintained by a vacuum pump, not shown. In correction gas chamber 18 a positive pressure relative to the atmosphere but slightly lower than tank pressure is maintained by means of a well-known type of differential pressure regulator, not shown. By way of example, the pressure in correction gas chamber 18 may be around 0.2 bar below the positive pressure in storage tank 5 By way of example and not limitation, the pressure of the gas in the gas filled space 4 above liquid 20 in the tank 5 may be 3.0 bar.

The filler valves are designated generally by the reference numeral 11. Each filler valve has a valve block 19 which is fastened to the underside of tank 5. Valve block 19 has a liquid passageway 2 which extends substantially vertically and which is in communication with the liquid 20 in tank 5 by means of a hole in the floor of the tank 5. The upper end of the liquid feed passageway 2 can be opened and closed by means of a vertically movable liquid feed valve 3. The lower end of liquid feed passageway 2 is in direct communication with the interior of the bottle 17 which is connected to the centering bell 12. The centering bell 12 is supported by means of a guide rod 13 so as to be movable downwardly to effect a seal with the mouth of the bottle and upwardly to allow a bottle to be positioned under the filler valve and to be conveyed away when the bottle has been filled and any excess liquid has been expelled from the bottle by way of the new method.

A vertical gas return tube 1 is positioned in the center of the liquid feed passageway 2. The lower tubular extension 21A of gas return tube 1 is exchangeable for an extension of different lengths for different desired fill levels Extension 21A projects into the bottle 17 and the upper end of vertical gas return tube 1 projects into the gas filled space 4 of tank 5. The lower tip 21 of the gas return line 1 determines the fill level for the bottle in a conventional manner for counter pressure filling. The upper end of gas return tube 1 can be closed and opened as required during a filling operation by moving the stem of a gas conduction valve 22 relative to its valve seat 40. The gas return tube 1 containing valve seat 40 of the gas conducting valve 22 as well as the body of the liquid feed valve 3 are movably supported on the stationary gas return tube 1. Both valve bodies are coupled by means of a spring 41 and reacting on a sleeve 23 so as to be mutually movable A lever 24 having a roller 42 on its end is supported in the wall of tank 5 such that it can be rotated and braked The roller lever has a control fork 25 which permits the valve body of the gas conducting valve 22 to be raised or lowered so it presses the liquid feed valve 3 downwardly into sealing position on valve seat 43 by means of the intermediate sleeve 23 or releases it in the upward direction. The liquid feed valve 3 is caused to open by means of a spring 44 only when the gas pressure in the bottle 17 becomes equalized with the pressure of gas in gas filled space 4 in tank 5 before the liquid feed valve 3 is opened to fill the bottle as will be elaborated later.

The structure and function of the filler valves 11 are further developed as follows. Assume that a bottle 17 is sealed to centering bell 12 and that the filler valve has orbited with tank 5 to where filling of the bottle is about to begin. The first thing that happens is that evacuation of air from the bottle by means of a vacuum valve 16 being opened as a result of encountering the cam 8*c*. The vacuum system will be elaborated later. After a short evacuation interval the roller 42 at the upper region of the filler valve encounters a cam, not shown, which starts swiveling of lever 24. A fork 25, which is coupled to lever 24, rises as a result of the lever having swiveled through a relatively small angle. This lifts the stem of gas conduction valve 22 from valve seat 40 on gas supply and return tube 1 and the evacuated bottle is filled with non-oxidizing gas, such as carbon dioxide, from gas filled space 4 in liquid storage tank 5.

At the same time that the fork 25 is lifting the stem of the gas conduction valve 22, a sleeve 50 which is concentric to gas supply and return tube 1 and is slidable on tube 1, is also lifted. Lifting of sleeve 50 allows the force of a spring 41, which is interposed between a shouldered sleeve 51 and another sleeve 23, to be relieved with the result that the sleeve 23 is raised on sleeve 51 so the latter no longer applies significant force to the top end of the liquid feed valve 3 which was closed on its seat 43 at the beginning of the filling cycle now being described and it remains closed for the present.

Spring 44 presently has some stored force which has a tendency to open liquid feed valve 3 which does not open yet. Liquid feed valve 3 is in readiness for opening since its positive closure has been eliminated by manipulation of the sleeves. Meanwhile, gas from the gas filled space 4 in tank 5 is flowing into the bottle 17 through gas supply and return tube 1. There is no force closing the liquid feed valve 3 other than the pressure in tank 5 at this time. As soon as the gas pressure in bottle 17 becomes equal to the pressure in tank 5, spring 44 opens liquid feed valve 3 and liquid 20 flows by gravity from tank 5 through liquid passageway 2 into the bottle. As previously indicated, when the liquid level in the bottle 17 reaches the open tip 21 of the gas supply and return tube extension 21A, liquid flow stops automatically because the gas pressure applied to the liquid in the bottle by way of gas supply and return tube 1 is balanced against the pressure applied to the liquid in the bottle by the gas in gas filled space 4 transmitting force through liquid in the tank. An instant later, roller 42 is on that part of a cam, not shown, which causes fork 25 to be pushed down to thereby close gas conduction valve 22 and liquid feed valve 3 positively.

Figure 1A:
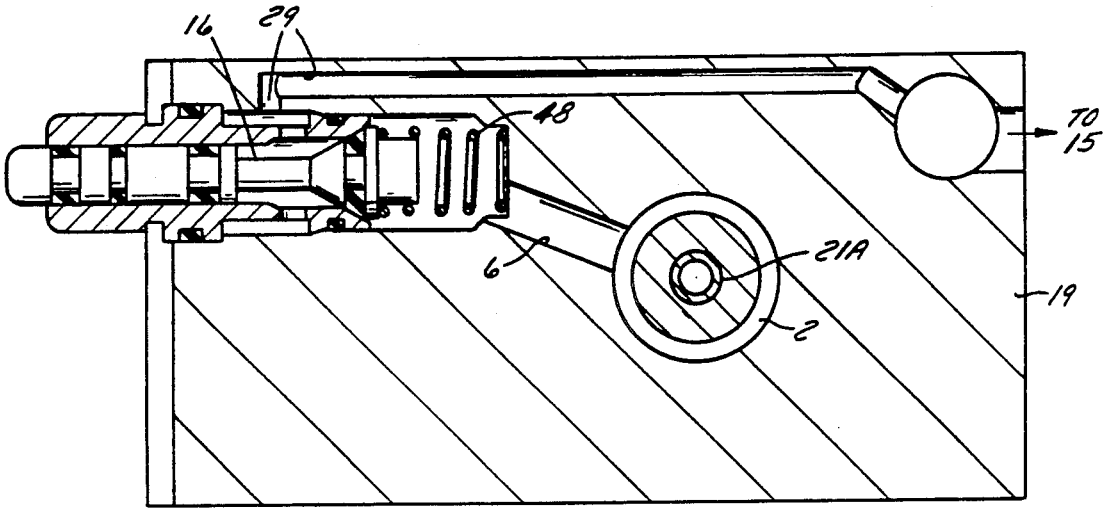
FIG. 1A is a transverse section taken on a line corresponding with 1A—1A in FIG. 1.

There is a conduit 6 beginning where the lead lines from the lowermost use of the numeral 6 are applied in FIG. 1 and this short section of conduit is also shown in FIG. 1A. The conduit 6 connects the liquid feed passageway 2 to the interior of bottle 17 when it is sealed to the centering bell 12 and to the gas filled space 4 in tank 5 while at the same time bypassing the gas return tube 1 Conduit 6 connects to liquid feed passageway 2 below liquid feed valve 3. Conduit 6 extends upwardly from liquid feed passageway 2 through valve block 19 and then by means of a generally vertical part of the conduit marked 6 to the bearing block 26 of the roller lever 24 and past a valve 10 for the gas to flow from gas filled space 4 in the tank to vertical conduit 6 by means of a short horizontal passageway or conduit portion also marked 6.

The arrangement of the conduits for connecting the interior of a bottle to the vacuum chamber 15 by means of vacuum valve 16 is more apparent in FIG. 1A considered in conjunction with FIG. 1. FIG. 1A clarifies how the first section of conduit 6 connects the bottle to the chamber of vacuum valve 16, which is occupied by valve closing spring 48, so that when the vacuum valve 16 is opened by cam 8*c* there is a passage via a conduit 29 to vacuum chamber 15.

A valve 10 that is seated in bearing block 26 which is in conduit 6 is normally biased closed by a spring 45. Thus, conduit 6 is normally closed off. The valve 10 is opened under the influence of a post 27 extending from a guide rod 13 which connects to centering bell 12. Thus, when a bottle is pressed into the centering bell, valve 10 in conduit 6 is opened. If there is no bottle pressed into the centering bell 12 or if the bottle breaks no force is developed in guide rod 13 and post 27 in which case valve 10 will remain closed so no gas is lost through conduit 6 if there is no bottle or a cracked bottle sealed to the centering bell 12 of the filler valve.

A shut-off valve 7 is also installed in valve block 19 to control flow in conduit 6. The movable valve sealing element of shut-off valve 7 is normally pressed against its valve seat by means of a spring 46. Shut-off valve 7 is shown in its closed position in FIG. 1. Shut-off valve 7 can be opened temporarily during operation of the counterfilling machine at the desired position, as the bottles orbit in a circular path, by means of a push rod and a stationary cam 8*a* in a valve control assembly 8. The position of the cam 8*a* is indicated by a dot-dashed line in FIG. 1.

Below valve 7 there is a relief valve 14 having a discharge port 28 that discharges into the atmosphere. Relief valve 14 is connected in conduit 6 in the region between shut-off valve 7 and the discharge to liquid feed passageway 2. The relief valve resides in valve block 19. Its movable valve disk is normally pressed against its seat by a spring 47 whereby the connection from conduit 6 to the discharge port 28 is blocked The discharge port 28 is presently blocked in FIG. 1 The relief valve 14 is temporarily opened at a specific point along the orbital path of the filling unit 11 by means of a stationary cam 8*b* of the control valve assembly 8, as indicated by the dot-dashed line, through a push rod for the inside of the bottle 17 to be connected to the atmosphere.

Figure 1B:
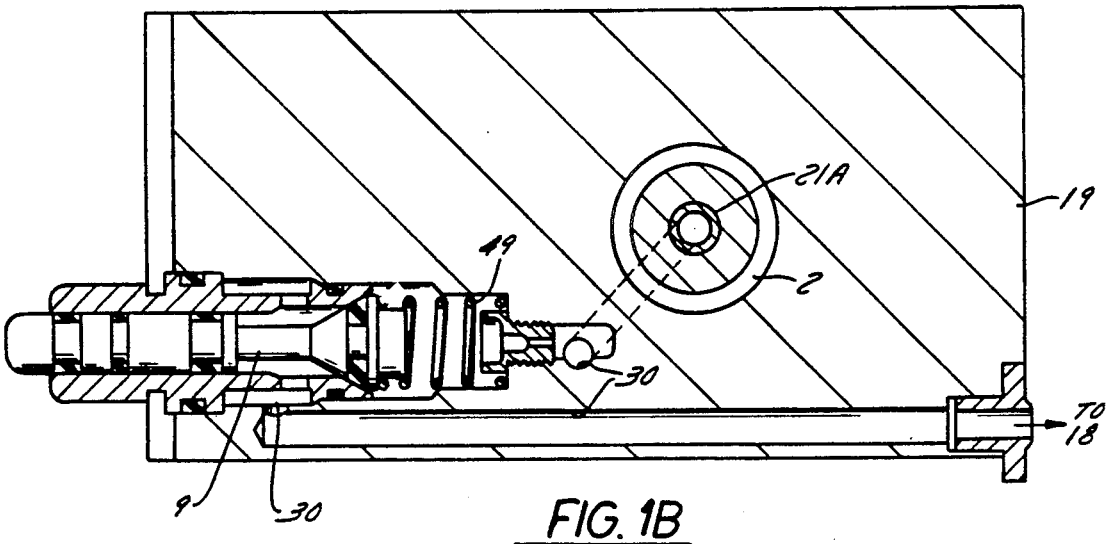
FIG. 1B is a transverse section taken on a line corresponding with 1B—1B in FIG. 1.

Furthermore a vacuum valve 16 is arranged below the relief valve 14 in the region between the shut-off valve 7 and the discharge into the liquid feed passageway 2 Vacuum valve 16 also resides in valve block 19 and is connected to annular vacuum chamber 15 by means of a channel 29 which bypasses the liquid feed passageway 2 transversely to the valve block 19. The body of vacuum valve 16 is normally pressed against its seat by a spring, 48 for interrupting communication between conduit 6 and vacuum chamber 15. Vacuum valve 16 is shown closed in FIG. 1 and 1A. At a specific point in the orbital path of the filler valves 11, the vacuum valve 16 is temporarily opened through a stationary cam 8*c* of the valve control assembly 8. Thus, the bottle 17 is evacuated through the first section of conduit 6, vacuum valve 16 and vacuum channel 29 A conduit 30 used in connection with correcting the bottle fill level leads to a so called correction valve 9 which rests in valve assembly block 19 and is connected laterally to the gas supply and return tube 1 below the pressure gas conducting valve 22 at the level of liquid feed passageway 2. The correction gas conduit 30 leads off from the correction valve 9 transversely through valve block 19 past the liquid feed passageway 2 and to correction chamber 18 which, by way of example and not limitation, may be pressurized at 2.8 bar as compared with the 3.0 bar in tank 5. The valve stem for the correction valve 9 is normally pressed against its seat by means of a spring 49, represented by parallel dash-dot lines, represented by parallel dash-dot lines, whereby the connection from passageway 2 to the correction chamber 18 can be interrupted. At FIG. 1B in conjunction with FIG. 1 clarifies how the gas supply and return tube 21A conduct excess liquid, which is forced out of the bottle, to the beginning of conduit 30 and then through the spring 49 chamber of correction valve 9 after which the excess liquid is conducted through the long continuation of conduit 30 to the correction chamber 18. A specific position of the bottle and filler valve in the circular orbit, the correction valve 9 is temporarily opened through a stationary cam 8*d* of the valve control assembly 8 by means of a push rod. The gas return tube 1 is thereby connected to the correction gas chamber 18 in the region between the open end tip 21 of gas return tube 1 and the gas valve 22 by means of the correction conduit 30.

A filling operation carried out with the new counterpressure valve design occurs in the following manner:

Initially, an empty bottle 17 is pressed to the seal in the centering bell 12 by means of a lifting element, not shown, and the centering bell moves upwardly with it Safety valve 10 is then opened by means of the guide rod 13. At this time, the vacuum valve 16 is briefly opened by means of cam 8*c* and the bottle is evacuated to a pressure of, by way of example and not limitation, 0.1 bar. Next, gas conducting valve 22 at the upper part of gas return tube 1 is opened by means of the roller lever 24 in conjunction with a cam plate, not shown, and control fork 25 whereupon the pressurized gas in gas filled space 4, which is primarily carbon dioxide but has some air mixed in it and is at a pressure of 3.0 bar, flows into gas return tube 1 from tank 5 to bottle 17 until the pressure of gas in gas filled space 4 in the tank 5 and the pressure of bottle 17 are equalized. Liquid feed valve 3 then responds to pressure equalization by opening automatically under the influence of the spring 44 and the liquid, typically beer, flows through liquid feed passageway 2 into the bottle. The gas which is displaced by the liquid flowing into the bottle flows back into tank 5 by way of gas return tube I until the liquid level reaches the lower tip 21 of gas return tube 1. Having the beer or other liquid seal off the lower tip 21 of the gas return tube causes the liquid inflow to the bottle to stop and the fill level as for example indicated by the solid line extending across the lower tip of gas return tube 1 is established. The gas conducting valve 22 at the upper end of gas return tube 1 and the liquid feed valve 3 are now positively actuated to close together by means of roller lever 24 and switching fork 25 whereby the liquid inflow is fully and finally terminated. At this stagé, the shut-off valve 7 is opened by means of cam 8*a* and bottle 17 is thereby connected to the gas filled space 4 in tank 5 by means of conduit 6 thereby bypassing the gas return tube 1 that is shut off by gas in gas filled space valve 22. The 3.0 bar pressure of the gas 4 in tank 5 is now applied to the bottle interior. At the same time, fill level correction valve 9 is opened by cam 8*d* and the bottle 17 is thereby connected to the moderately pressurized correction chamber 18 over the correction conduit 30 and the lower area of the gas tube, the correction chamber containing pressurized gas at 2.8 bar in this example. As a consequence of the 0.2 bar pressure difference between gas in gas filled space 4 in tank 5 and correction chamber 18, the higher pressurized gas flows out of gas filled space 4 into bottle 17 to thereby expel the liquid that lies above the tip 21 of gas return tube 1 into the correction chamber 18 by way of duct 30. As a consequence of the small pressure differential between tank 5 and the correction chamber 18 the saturation pressure for carbon dioxide is always maintained and the fill level correction takes place smoothly without carbon dioxide being liberated undesirably from the liquid. After a short but sufficient period of time for expelling the excess liquid, in order to expel the liquid to just below the tip 21 of return tube 1 even with greatly overfilled bottle 17, the shut-off valve 7 and correction valve 9 are closed again. The liquid that is expelled into correction chamber 18 flows off through a line and regulating valve, not shown. The excess liquid can, of course, be returned to tank 5 if desired.

Following the fill level correction, a pressure of at least 2.8 bar prevails in bottle 17 in this example while it is still sealingly coupled to the centering bell 12. The final relief procedure reduces this pressure to atmospheric pressure For this purpose, the relief valve 14 is momentarily opened by means of cam 8*b*, whereby the pressurized gas flows from the bottle into the atmosphere through the lower area of conduit 6 and discharge port 28 of relief valve 14. Now, the filling unit is closed off and the bottle that is filled precisely to the desired level is lowered along with centering bell 12 so that the safety valve 10 in conduit 6 is closed again. The bottle is now ready for being transported to the next station which may be a capping machine, not shown.

Figure 2:
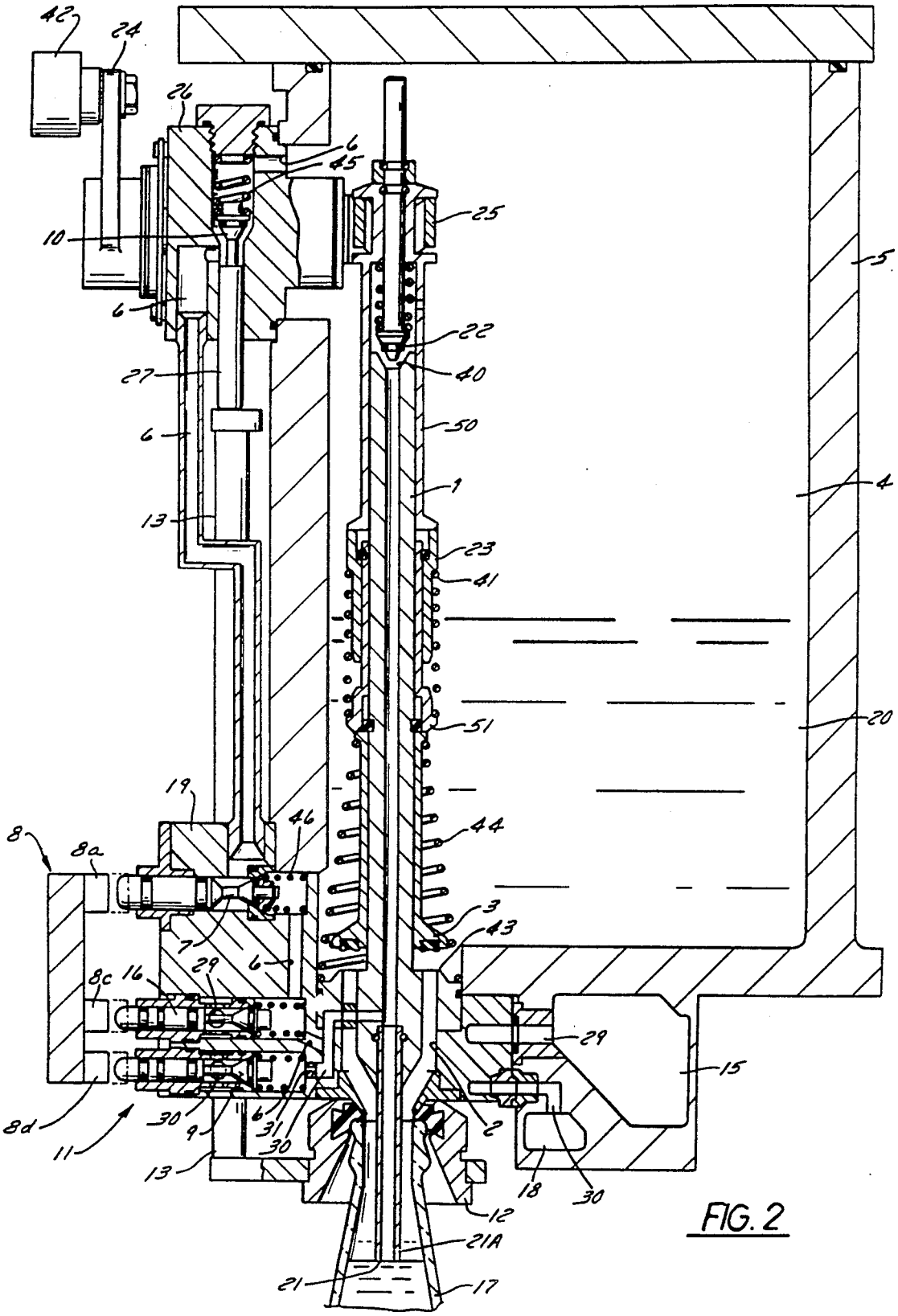
FIG. 2 is a vertical section through a counterpressure filling machine in the region of a modified version of the filler valve.

The embodiment of the counterpressure filling machine depicted in FIG. 2 differs from that in FIG. 1 in that there is no relief valve, that a throttle orifice 31 is installed in correction gas conduit 30 which leads from the gas return tube 1 to the throttle orifice 31, and that atmospheric pressure is maintained in the correction chamber 18. During the fill level correction procedure, when the shut-off valve 7 is open, for level correction the pressurized gas from the gas filled space 4 in tank 5 and the expelled liquid thus flow quickly through throttle orifice 31 to correction chamber 18 as a result of the 2.0 bar pressure differential and the discharge is into atmospheric pressure After closing the shut-off valve 7, correction valve 9 can, if required, remain open slightly longer so that the pressure in bottle 17 is consistently reduced to atmospheric pressure. In this embodiment, no separate pressure relief procedure is necessary. The expelled liquid can be led from the correction chamber into a pressure free space.

I claim:

1. Bottle filling apparatus comprising:

a tank for containing the liquid for filling the bottle and a pressurized gas over the liquid, a filling device having a gas delivery and return tube for delivering gas from said tank to a bottle which is coupled to said device to be filled and for returning the as from the bottle to said tank when the gas is displaced by said liquid being admitted to the bottle, said tube having a lower end for extending into said bottle to establish the level to which said bottle is filled with liquid, a valve in said gas delivery and return tube and means for controlling said valve to open for delivering said gas to said bottle and to close when the bottle is filled to said level such that any liquid draining into the bottle after closure is excess, said filling device having a liquid supply valve and a liquid passageway controlled by said supply valve to conduct liquid from said tank to said bottle when said supply valve opens concurrently with the pressure in said tank becoming equal tot he gas pressure in said bottle, a chamber having an internal gas pressure which is lower than the pressure in said tank, a conduit having an inlet in communication with the gas in said tank and an outlet in communication with said liquid passageway and there is a duct between said passageway and said chamber having the lower gas pressure, a fill level correction valve in said conduit and means for controlling said correction valve to open momentarily after said liquid supply valve i closed to allow conduction of gas from said tank to the liquid passageway and bottle for the gas to propel said excess of liquid through said duct to said chamber.

2. The apparatus according to claim 1 including:

a shut-off valve in said conduit, said means for controlling said fill level correction valve including means for opening said shut-off valve simultaneously with opening of said level correction valve for a predetermined short period of time.

3. The apparatus according to claim 2 including a relief valve having an outlet in communication with the atmosphere and an inlet coupled to said conduit between said shut-off valve and said liquid passageway.

4. The apparatus according to claim 2 including a vacuum chamber, a vacuum valve and means for controlling said valve, said valve being connected to said conduit between said shut-off valve and said liquid passageway.

5. The apparatus according to any one of claims 1 or 2 including:

a centering bell by which the bottle is coupled to aid filling device for being filled and a member guided for moving vertically, said centering bell being fastened to said member for being moved upwardly in response to a bottle being raised into coupling relationship with said bell, a safety valve installed in said conduit and operable to an open condition by upward movement of said member resulting from raising said bottle into coupling relation with entering bell.

* * * * *

UNITED STATES PATENT AND TRADEMARK OFFICE

CERTIFICATE OF CORRECTION

PATENT NO. : 5,082,033

DATED : January 21, 1992

INVENTOR(S) : Wilhelm Weiss

It is certified that error appears in the above—identified patent and that said Letters Patent is hereby corrected as shown below:

Column 8, line 35:
Delete "as" and substitute --- gas ---.

Column 8, line 49:
Delete "tot he" and substitute --- to the ---.

Column 8, line 60:
After "valve" delete "i" and substitute --- is ---.

Column 10, line 3:
Delete "aid" and substitute --- said ---.

Column 10, line 12:
Delete "entering" and substitute --- centering ---.

Signed and Sealed this

Fourteenth Day of September, 1993

Bruce Lehman

*Attest:*

BRUCE LEHMAN

*Attesting Officer*

*Commissioner of Patents and Trademarks*